US011373491B2

(12) United States Patent
Stone et al.

(10) Patent No.: US 11,373,491 B2
(45) Date of Patent: Jun. 28, 2022

(54) EMERGENCY COMMUNICATING FLASHING LIGHT SECURITY SYSTEM

(71) Applicants: Robert M. Stone, Pittsburgh, PA (US); Christopher Walton, Pittsburgh, PA (US)

(72) Inventors: Robert M. Stone, Pittsburgh, PA (US); Christopher Walton, Pittsburgh, PA (US)

( * ) Notice: Subject to any disclaimer, the term of this patent is extended or adjusted under 35 U.S.C. 154(b) by 672 days.

(21) Appl. No.: 16/317,875

(22) PCT Filed: Oct. 3, 2017

(86) PCT No.: PCT/US2017/054837

§ 371 (c)(1),
(2) Date: Jan. 15, 2019

(87) PCT Pub. No.: WO2018/067497

PCT Pub. Date: Apr. 12, 2018

(65) Prior Publication Data

US 2021/0327229 A1 Oct. 21, 2021

Related U.S. Application Data

(60) Provisional application No. 62/403,334, filed on Oct. 3, 2016.

(51) Int. Cl.

| | |
|---|---|
| ***G08B 5/38*** | (2006.01) |
| ***H05B 47/19*** | (2020.01) |
| ***H05B 47/17*** | (2020.01) |

(52) U.S. Cl.

CPC ..... *G08B 5/38* (2013.01); *H05B 47/17* (2020.01); *H05B 47/19* (2020.01)

(58) Field of Classification Search

CPC ..... G08B 5/38; H05B 47/17; H05B 47/19
USPC ..... 340/331
See application file for complete search history.

(56) References Cited

U.S. PATENT DOCUMENTS

| | | | | |
|---|---|---|---|---|
| 842,729 | A | 1/1907 | Vernet | |
| 2006/0193158 | A1* | 8/2006 | Fukaya | H02J 3/40 363/132 |
| 2007/0035255 | A1 | 2/2007 | Shuster et al. | |
| 2008/0012229 | A1 | 5/2008 | Yu et al. | |
| 2008/0122295 | A1* | 5/2008 | Yu | H05B 47/115 307/116 |
| 2014/0025373 | A1 | 9/2014 | Norem et al. | |
| 2014/0253733 | A1* | 9/2014 | Norem | H04N 5/23206 348/159 |

(Continued)

*Primary Examiner* — Kerri L McNally
(74) *Attorney, Agent, or Firm* — Spilman, Thomas & Battle PLLC; William P. Smith

(57) ABSTRACT

An emergency lighting security system has a system control panel, a plurality of predetermined light fixtures, each light fixture in communication with a smart switch in data communication with the system control panel. A building distribution panel for distributing power to the light fixtures; Wi-Fi repeaters for boosting signal strength within an installation, and a key-fob operable by a homeowner to initiate an emergency signal to the control panel to set the smart switches into a strobe or flash mode controlling the light fixtures. Also a method of controlling an emergency lighting security system via a wireless control panel with Wi-Fi switches to set predetermined exterior and interior light fixtures into a strobe or flashing mode.

17 Claims, 2 Drawing Sheets

(56) References Cited

U.S. PATENT DOCUMENTS

2016/0172904 A1* 6/2016 Recker ..... H02J 7/0068
307/23

* cited by examiner

EMERGENCY COMMUNICATING FLASHING LIGHT SECURITY SYSTEM

CROSS-REFERENCE TO RELATED APPLICATIONS

This patent application claim the benefit of and priority to U.S. Provisional Patent Application Ser. No. 62/403,334 entitled "Emergency Communicating Flashing Light Security System", filed Oct. 3, 2016, which patent application is hereby incorporated by reference.

BACKGROUND

The application generally relates to an emergency communicating flashing light security system. The application relates more specifically to an emergency communicating flashing light security system designed to be a stand-a-lone system, but which can also be integrated into an existing security system, to flash or strobe selected light fixtures on an exterior and turn on selected interior lights in a constant/non-flash mode an interior of a premises.

Currently emergency responders may be delayed in responding to an emergency while driving on a street searching for location identifiers such as house numbers. In some neighborhoods the house numbers may not be visible. Often there may be no ambient light or street lighting in an area, leaving the responders to navigate a dark area, which is a safety concern. Neighbors may be unaware that an emergency or other problem is ongoing in that home.

Many homes today do not have an existing home security system due to the expensive of installation and ongoing monthly monitoring services. Financial arrangements can be arranged for purchasing a home security system, which only results in further expense incurred by the homeowner.

By not having to search for house numbers, responders can immediately determine which home is in an emergency situation and those extra minutes could save a life.

What is needed is a system and/or method that allows emergency responders to determine which home is in an emergency situation or provides other advantageous features. Other features and advantages will be made apparent from the present specification.

SUMMARY

One embodiment relates to a switch controller for switching power to a light fixture. The switch controller is in wireless data communication with an actuator device. The switch controller has a power supply, a wireless communication circuit; and a processor for programmably generating an on-off control to toggle the light to generate a strobe effect, and/or turn on selected interior lights in a constant mode, no flash, in response to receiving an actuation signal from an actuator device.

Another embodiment relates to a lighting security system for a residence or home. The lighting security system includes one or more light fixtures connected to a circuit of a distribution panel through a switch controller and at least one actuator device. The switch controller is in wireless data communication with the actuator device. The switch controller has a power supply, a wireless communication circuit; and a processor for programmably generating an on-off control to toggle the light to generate a strobe effect in response to receiving an actuation signal from an actuator device.

Another embodiment relates to an emergency lighting security system including a system control panel, a plurality of predetermined light fixtures, each light fixture in communication with a smart switch in data communication with a controller, e.g., a system control panel or wireless portable fob device. A building distribution panel for distributing power to the light fixtures; Wi-Fi repeaters for boosting signal strength within an installation, and a key-fob operable by a homeowner to initiate an emergency signal to set the smart switches into a strobe or flash mode or constant mode directly to the smart switches from the key FOB controlling the light fixtures.

Another embodiment relates to a method of controlling an emergency lighting security system via a wireless control panel with Wi-Fi switches to set predetermined exterior and interior light fixtures into a strobe/flashing mode or constant ON mode, no flashing or flashing mode. Optionally a strobe or flashing mode may include an adjustable timing sequence or interval that may vary according to predetermined situations or locales.

The present disclosure provides a means for emergency responders to respond more quickly, without searching for house numbers, and to locate a house by its flashing lights.

In addition, where a home invasion is involved, flashing lights of the present invention may deter potential intruders who do not want to be exposed by lights.

A further advantage of the disclosed security lighting is to provide a lighted area so as the police are not responding to an unlighted or dark area where crimes are more likely.

Also, because the disclosed system may be a stand-alone system, homeowners may purchase the lighting system and not require ongoing payments to a monitoring service or other third party security services, since the homeowner may purchase the system with a single payment and enjoy the security of knowing that in case of an emergency they have the ability to set their designated lights in a flashing mode for emergency responders or for neighbors to see the lights flashing and knowing there is a problem in that home.

Moreover, by not having to search for house numbers, responders can immediately determine which home is in an emergency situation and those extra minutes could save a life. Alternative exemplary embodiments relate to other features and combinations of features as may be generally recited in the claims.

BRIEF DESCRIPTION OF THE FIGURES

The application will become more fully understood from the following detailed description, taken in conjunction with the accompanying figures, wherein like reference numerals refer to like elements, in which.

DETAILED DESCRIPTION OF THE EXEMPLARY EMBODIMENTS

Before turning to the figures which illustrate the exemplary embodiments in detail, it should be understood that the application is not limited to the details or methodology set forth in the following description or illustrated in the figures. It should also be understood that the phraseology and terminology employed herein is for the purpose of description only and should not be regarded as limiting.

Figure 1:
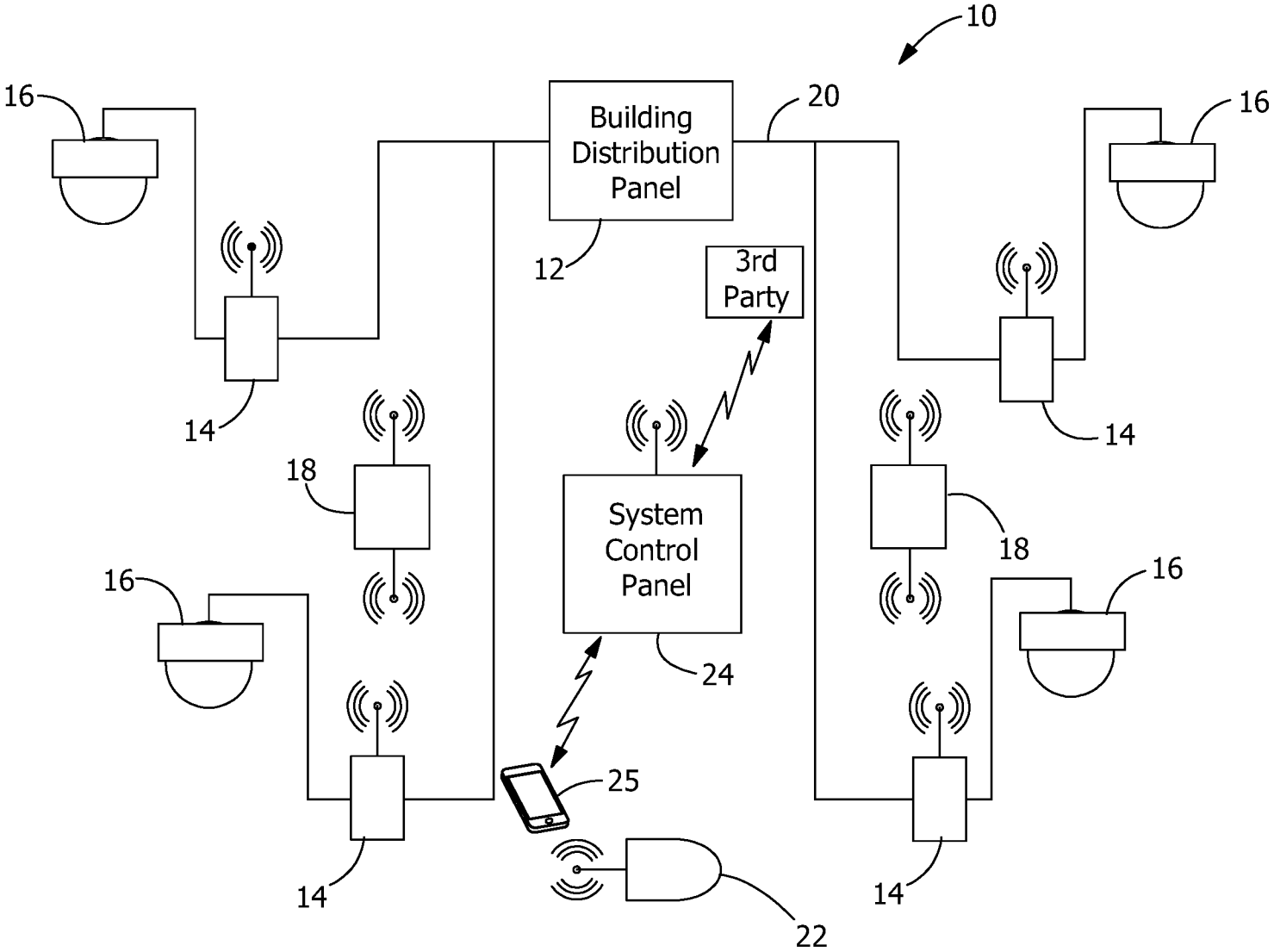
FIG. 1 shows a schematic diagram showing an exemplary lighting security system.

Referring to FIG. 1, an exemplary lighting security system 10 is shown. System 10 includes an electrical distribution panel 12. Panel 12 includes electrical circuitry and disconnecting means, e.g., circuit breakers, fuses, disconnects, etc., for general use and lighting in a building, e.g., a house. One or more electrical power circuits 20 from panel 12 are connected to multiple light fixtures 16. Light fixtures may be pre-existing light fixtures, e.g., in the case of a retro-fit installation, or newly installed light fixtures in newly constructed buildings. Each light fixture 16 that is designated as an emergency light for system 10 is connected to panel 12 through a communication switch 14.

In an exemplary embodiment, retrofit systems existing light switches are replaced with communication switches 14 for controlling light fixtures 16. The light fixtures may be existing light fixtures, as the system may be adapted to existing switches and light fixtures and does not require the addition of new or replacement light fixtures. Communication switches 14 include wireless communication printed circuit boards (PCB) including either a receiver or an internal PCB to communicate with a centrally located control panel 24. Control panel 24 may be mounted in a utility room, basement, attic or other functional location in the building. Control panel 24 includes wireless communication devices, e.g., transceiver, and programmable, microprocessor-based controls for controlling operation of the emergency lighting system, as described in greater detail below. The homeowner may operate communication switches 14 via on/off toggle or pushbutton or rocker-type operators to control the fixtures as they would a normal light switch.

In one embodiment system 10 may be configure as a stand-a-lone system. Control panel 24 includes a flash or strobe control to communicate an emergency mode operation to communication switches 14 to control the associated emergency light fixtures 16. In one embodiment emergency light fixtures 16 include both exterior and interior light fixtures so that emergency responders may easily and immediately identify the location at which emergency services are requested. The home owner predetermines which light fixtures will flash or strobe when lighting security system 10 is activated. Activation may be accomplished manually i.e., by the homeowner using a fob 22, e.g., from within the house, or remotely through an existing home monitoring system or other 3rd party systems, e.g., Life Alert®.

In operation, if an emergency situation arises, system 10 may be activated either by a remote controller, such as a key fob 22 in the possession of a homeowner in the case of a stand-a-lone system. Alternatively, system 10 may be activated by receiving a signal from an existing security system. In response to an emergency signal being received by control panel 24, control panel 24 transmits an electronic signal out to communication switches 14 to initiate or actuate a flash/strobe mode and constant ON mode for interiors. Light fixtures 16 associated with communication switches 14 flash or strobe in response to the control signal, thereby making the building easy to identify for emergency response units.

It should be noted that Wi-Fi may be used as one mode of communication. Alternately, system 10 may be interconnected to the building power distribution circuits through capacitive filters to transmit high frequency signals over the power lines between communication switches 14 and control panel 24. In the case of a wireless (Wi-Fi) system, Wi-Fi repeaters 18 may be disposed in appropriate locations in the respective building to extend the range and coverage of the entire system 10.

As indicated above, system 10 may be a stand-alone system in which a hand held key fob or similar controller 22 is provided to one or more residents. In one embodiment a key FOB can be configured to control up to 10 smart switches 14. Multiple key FOBs, e.g., one hundred or more FOBs, may be used to control switches 14. In case of an emergency, a button on a key fob 22 may be activated to transmit an emergency signal to either switch 14 or control panel 24. In response to the emergency signal control panel 24 transmits a signal to the designated communication switches 14 to activate the designated light fixtures 16 into a flashing/strobing mode indicating an emergency situation. System 10 may also be incorporated into existing monitoring and security system, medical alert systems, or other systems designed for security or emergency notification situations.

System 10 enables emergency responders to respond more quickly to emergency situations, because it is not necessary to look for house numbers. Flashing lights are more readily visible at night when many emergencies occur. In cases of a home invasion, operation of system 10 with flashing lights 16 may deter invaders that do not want any type of lights that may cause them to be more easily identified by witnesses and victims. System 10 also provides a lighted area that is safer for emergency personnel, allowing them to better see where they are walking and if any danger is present.

Many homes today do not install a home security system for financial reasons. System 10 allows end users the ability to purchase and install the emergency lighting system without incurring monthly payments. They can purchase the system with a one-time payment and enjoy the security of knowing that in case of an emergency they have the ability to set their designated lights in a flashing mode for emergency responders or for neighbors to see the lights flashing and knowing there is a problem in that home.

System 10 may also be integrated with a security system in a home or commercial building. Motion sensors along with surveillance cameras and sirens may be incorporated so when motion is detected a signal is transmitted to the control panel to activate the designated switches 14 controlling light fixtures 16 selected by the homeowner.

Central control panel 24 includes communication relays or switches that transmit signals to addressable switches 14 to enter an alert mode. Control panel 24 may include one or more serial communication ports to allow other security or monitoring companies to connect to panel 24, and which would also activate the relays or switches that when that particular system goes into alert mode the relays or switches would activate and activate a flashing/strobing mode. Central control panel 24 has communications software and hardware for communicating with a mobile device 25, e.g., cellular telephone, or with a third party security monitoring service. System 10 may be controlled remotely from a cellular telephone 25 through a mobile software application if the optional control panel 24 is installed. Also, third party security monitoring services may include remote control features if system 10 is configured with a control panel 24.

In one embodiment system 10 may include Wi-Fi smart switches (4 each), wherein two Wi-Fi smart switches may be programmed for override-flashing exterior lights, and two Wi-Fi smart switches may be programmed for override-constant-on interior lights. The programmable option for override-flashing or override-constant-on is controlled in the switch 14, via hard-wired selector. The switches 14 can be wired with or without a neutral wire available from the switch junction box. The switch 14 can also replace a 3-way switch in the same way as a single pole switch. Central control panel 24 may include a 120/277 volt cord and plug for power to be plugged into wall outlet; a communications board to command the switches 14; IEEE 802.11 Wi-Fi module, bluetooth connection, or voice activation feature may be configured to communicate with and control the switches 14; a USB port or other component needed for setup, diagnostics, and 3rd party security equipment integration; a panel-mounted buzzer to provide audible notification of system activation; a key-fob controller 22 that can activate or de-activate the Control Panel 24 remotely; and an optional Wi-Fi Repeater to provide signal boost for the Control Panel 24. Switch 14 may be controlled by flash/strobe and "constant on" mode through programming the PCB, as a 120/277 V, 50/60 Hz switch with a PCB board for communications. Alternately the system may be MAC addressable switches.

Alternately, it is noted that the system control panel is an optional feature. FOB 22 can be configured to communicate directly to switches 14 without control panel 24 if the customer only wishes to use the FOB. Control panel 24 is only required when using a mobile application to control the system 10 remotely from a mobile device, or if the system is to be incorporated into an existing 3rd party security alarm system.

Figure 2:
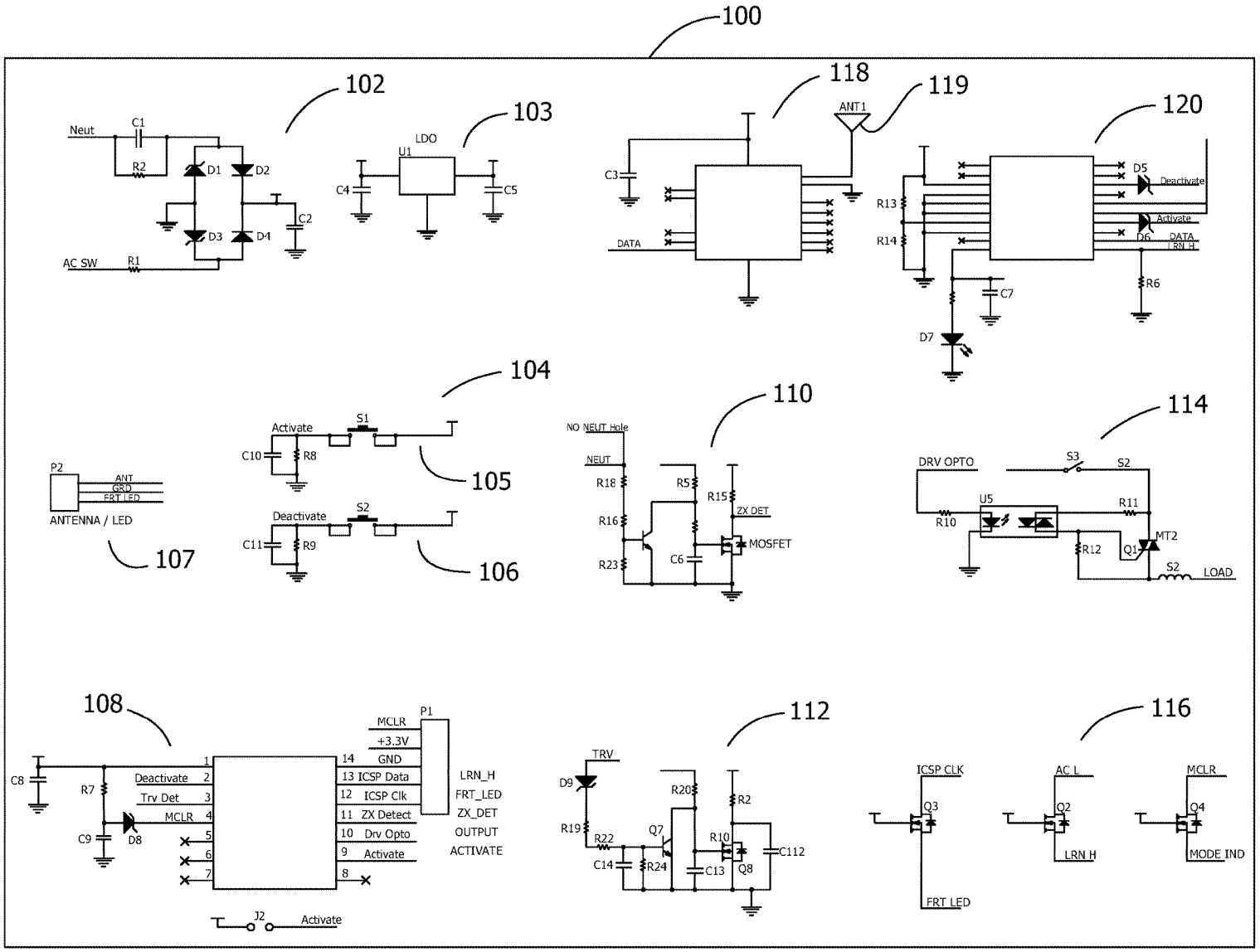
FIG. 2 shows a printed circuit board for a switch of the lighting security system.

Referring next to FIG. 2, an exemplary embodiment of a PCB 100 is shown. As discussed above, PCB 100 is incorporated into each switch 14. PCB 100 includes a low power bias supply module 102 including a low voltage dropout circuit 103 that operates at a very low power consumption. An antenna board 104 with front panel buttons 105, 106 and an antenna and LED indicator with antenna 107. A microprocessor board 108 for on/off control of switch 14 is provided for programmably controlling the switches 14. An AC zero-cross detect circuit 110 and a traveler detect 112 are interconnected on PCB to allow control of switches 14 in the absence of a neutral wire from distribution panel 12, and to control 3-way switches. AC zero-cross detect circuit 110 may be used to generate a sync pulse related to the AC voltage phase angle for the power control circuit. Traveler detect circuit 112 detects when a switch 14 is wired in a 3-way circuit. Power switching module 114 and dual purpose I/O modules may also be included on PCB 100. A receiver 118 provides wireless transfer of serial data, control or command information in a predetermined frequency band, e.g., 260 MHz to 470 MHz. In communication with a transmitter of the fob 22 or control panel 24, a wireless link 119 on receiver 118 transfers serial data at up to 10 Kbps. The Key Fob combined with the LR Series receiver and the MS Series decoder, can communicate with switches at a range up to 750 feet. A decoder module 120 provides remote control operation. The status of up to eight buttons or contacts may be securely transferred in the wireless link 119. A 24-bit address size provides unique data transmissions with low possibility of conflicting addresses. Decoder 120 also identifies and outputs the originating encoder ID for logging and identification.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

The present application contemplates methods, systems and program products on any machine-readable media for accomplishing its operations. The embodiments of the present application may be implemented using an existing computer processors, or by a special purpose computer processor for an appropriate system, incorporated for this or another purpose or by a hardwired system.

In another embodiment of system 10 an auto-dialer may be programmed to dial 911. The auto-dialer may be located, e.g., in a lighting control panel. When the alert system 10 is activated with a programmed message giving the location address along with a message to emergency personnel to look for strobing/flashing lights. Emergency battery back-up may also be included in case of an A/C power failure.

A programmed app for a smart phone may be provided to users to allow a smart phone or other type of device, computer/laptop to interact with system 10, so that the smart phone may be used in place of the fob. The app may be downloaded to the smart device so that either the smart device or fob may activate lighting alert system 10.

In one embodiment the communicating switch may be, e.g., a 12 or 14 amp 120/277 v single pole with either an embedded chip or an external chip that would be encrypted and configured to receive a command from the main lighting alert control panel 24 as to what position the respect chip should be, e.g., strobing, flashing or other light sequence, or for the timing cycle for strobing/flashing. Switch 14 may be used for normal on/off operation. When the fob is activated in an emergency situation the switch normal on/off operation would be overridden in whatever position it may currently may be. Once the lighting alert system is deactivated, switch would return to the operating position in which the switch was prior to the emergency activation mode.

Finally, for new construction smart LED lighting may be attached to the eaves of homes or other structures being constructed whereas the fixtures versus a switch would be communicated with to turn on to strobe/flash or other sequence when the lighting alert system is activated. The lighting alert system would communicate with an encrypted chip controlling the fixtures to activate in an emergency situation. This application would be with the lighting alert system communicating directly to the fixture or switch if chosen.

It is important to note that the construction and arrangement of the lighting security system as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

As noted above, embodiments within the scope of the present application include program products comprising machine-readable media for carrying or having machine-executable instructions or data structures stored thereon. Such machine-readable media can be any available media which can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

The invention claimed is:

1. A switch controller for switching power to a light fixture comprising:

a switch controller in wireless data communication with a wireless communication switch; the light fixture connected to an electrical distribution panel through the wireless communication switch;

the switch controller having a power supply, a wireless communication circuit; and a processor for programmably generating an on-off control to toggle the wireless communication switch to generate a strobe effect to the light fixture;

wherein the wireless communication switch further comprises an antenna board having a pair of front panel buttons and an antenna.

2. The controller of claim 1, wherein the wireless communication switch further comprises an AC zero-cross detect circuit configured to generate a sync pulse related to the AC voltage phase angle for the power control circuit.

3. The controller of claim 1, wherein the wireless communication switch further comprises a traveler detect circuit, the traveler detect circuit configured to detect when the switch controller is wired in a 3-way circuit.

4. The controller of claim 1, wherein the wireless communication switch further comprises a receiver configured to transfer serial data, control or command information in a predetermined frequency band.

5. The controller of claim 1, wherein the wireless communication switch further comprises a decoder module;

the decoder module configured to provide remote control operation;

wherein a status of one or more buttons or contacts being securely transferred in a wireless data link; and the decoder module further configured to identify and output an ID of an originating one of the wireless communication switch.

6. The controller of claim 1, wherein the wireless communication switch further comprises an LED indicator for indicating a status of the one or more buttons or contacts.

7. The controller of claim 1, wherein the switch controller comprises:

a fob having at least one of an IEEE 802.11 Wi-Fi module, a wireless communication module, a Wi-Fi module, a bluetooth connection, or a voice activation feature.

8. The controller of claim 1, further comprising a control panel, the control panel comprising a communications board configured to command a plurality of MAC-addressed switches, an IEEE 802.11 Wi-Fi module, a bluetooth connection, or a voice activation feature.

9. The controller of claim 8, wherein the control panel is in data communication with and remotely controllable via a cellular telephone through a mobile software application.

10. A lighting security system for a residence or home comprising:

at least one light fixture connected to a circuit of a distribution panel through at least one actuator device;

and a switch controller in wireless data communication with the at least one actuator device;

the switch controller having a power supply, a wireless communication circuit; and a processor for programmably generating an on-off control to the at least one actuator device to toggle the light fixture to generate a strobe effect; and a control panel configured to command MAC-addressed switches; and at least one of IEEE 802.11 Wi-Fi module, bluetooth connection, or voice activation feature configured to communicate with the MAC-addressed switches;

wherein the at least one actuator device comprises a key-fob controller configured to remotely activate or de-activate the control panel.

11. The system of claim 10, wherein the actuator device comprises a Wi-Fi smart switch, the Wi-Fi switch being programmed to override-flashing exterior lights, and to override-constant-on interior lights.

12. The system of claim 10, wherein the wireless communication circuit further comprises a selector switch to control one or more flashing exterior lights or one or more constant-on interior lights.

13. The system of claim 10, wherein the at least one actuator device is wired without a neutral wire.

14. The system of claim 10, wherein the wireless switch controller is configured as a 3-way switch.

15. The system of claim 10, wherein the control panel further comprises a panel-mounted buzzer is configured to provide audible notification of system activation.

16. The system of claim 10, further comprising a Wi-Fi repeater configured to boost a signal for the control panel.

17. A method of generating a visible alarm signal comprising:

controlling a wireless communication switch via a switch controller;

initiating a security alarm via a wireless key fob actuator;

commanding MAC-addressed switches via a control panel;

communicating with the MAC-addressed switches via at least one of IEEE 802.11 Wi-Fi module, bluetooth connection, or voice activation feature;

transmitting a signal to the wireless communication switch to override a status of the wireless communication switch;

connecting a light fixture to the wireless communication switch; and generating a toggle signal from the switch controller to the wireless communication switch to strobe the light fixture.

* * * * *